US005240128A

United States Patent [19]

Ohm

[11] Patent Number: 5,240,128

[45] Date of Patent: Aug. 31, 1993

[54] AIRING AND DRYING FRAME

[75] Inventor: Heinz J. Ohm, Limburg, Fed. Rep. of Germany

[73] Assignee: Leifheit AG, Nassau/Lahn, Fed. Rep. of Germany

[21] Appl. No.: 883,359

[22] Filed: May 15, 1992

[30] Foreign Application Priority Data

May 18, 1991 [EP] European Pat. Off. ..... 91108114.9

[51] Int. Cl.[5] ..... A47F 5/00

[52] U.S. Cl. ..... 211/197; 211/119.01

[58] Field of Search ..... 211/197, 196, 119.01, 211/119.15

[56] References Cited

U.S. PATENT DOCUMENTS 4,574,961 3/1986 Keiels et al. .

4,735,326 4/1988 Steiner ..... 211/197

4,935,155 6/1990 Steiner ..... 211/119.15 X

FOREIGN PATENT DOCUMENTS 0113789 7/1984 European Pat. Off. ..... 211/119.01

390863 8/1965 Switzerland .

*Primary Examiner*—Robert W. Gibson, Jr.

*Attorney, Agent, or Firm*—Frishauf, Holtz, Goodman & Woodward

[57] ABSTRACT

An airing and drying frame comprises a vertical mast (1), a plurality of arms (4) for holding a clothesline (22), the arms (4) being pivotally mounted to the mast (1), and a retraction device for retracting the clothesline (22) into the arms (4) when the frame is being closed. During a closing action the clothesline (22) is pulled inward within the arms (4) by means of weights (9) sliding in a sliding channel (20) into a storing compartment (21) within the arms (4).

20 Claims, 3 Drawing Sheets

AIRING AND DRYING FRAME

BACKGROUND OF THE INVENTION

This invention relates to an airing and drying frame having a vertical mast on which a multiple-arm frame is mounted, which are generally known as clothes umbrellas.

These so-called clothes umbrellas, are known, for example, from U.S. Pat. No. 4,574,961 and Swiss Patent No. 390,863 and are very popular as airing and drying devices for clothing and laundry. They allow hanging of a large number of pieces of clothing and laundry in a small area. Even large articles, such as bed linens and tablecloths present no problems. These known clothes umbrellas have the advantage that they can be collapsed or folded and can be stored in a very small space when not in use, and that the clothesline is fully retracted into the arms of the device, protecting the clothesline from getting dirty. The disadvantages of the known designs are that the mechanism for retracting the clothesline is very complex, and that considerable force is necessary to open and close the arms.

The object of the present invention is to create an airing and drying frame with a device for retracting the clothesline, wherein the device for retracting the clothesline only requires insignificant additional technical expenditure compared with, for example, a clothes umbrella according to Swiss Patent No. 390,863, and wherein it can be opened and closed with very little force.

SUMMARY OF THE INVENTION

According to the present invention, a frame for airing and drying articles comprises support means; a plurality of arms extending from said support means and being pivotable relative to said support means between a folded position where said arms are adjacent said support means and an open position where said arms extend from said support means; a clothesline extending between adjacent arms and on which articles are to be hung; and wherein said arms each including retracting means for retracting the clothesline into the arms when the frame is folded to said folded position where said arms are adjacent said support means. The retracting means comprises a plurality of slider members slidable on said arms and which are movable relative to each other, end portions of said clothesline being attached to respective slider members; and an operating weight member at the outermost slider member on each of said arms, said operating weight member being slidable along the respective arm solely by the force of gravity, responsive to a raising movement of said arm from said open position to said folded position, and for acting on the outermost slider member to cause said outermost slider member to slide downwardly of said arm when said arm is raised toward said folded position, to thereby draw the clothesline into the respective arms.

According to the present invention, a very simple construction, combining an arm and a slideable weight, is achieved. The use of lead as a weight material for the operating element is particularly advantageous since it offers excellent sliding and, therefore, moving properties in its interaction with a sliding channel of the arm, and can additionally be coated with friction reducing material. Very easy handling and operation is the result.

DETAILED DESCRIPTION

Figure 1:
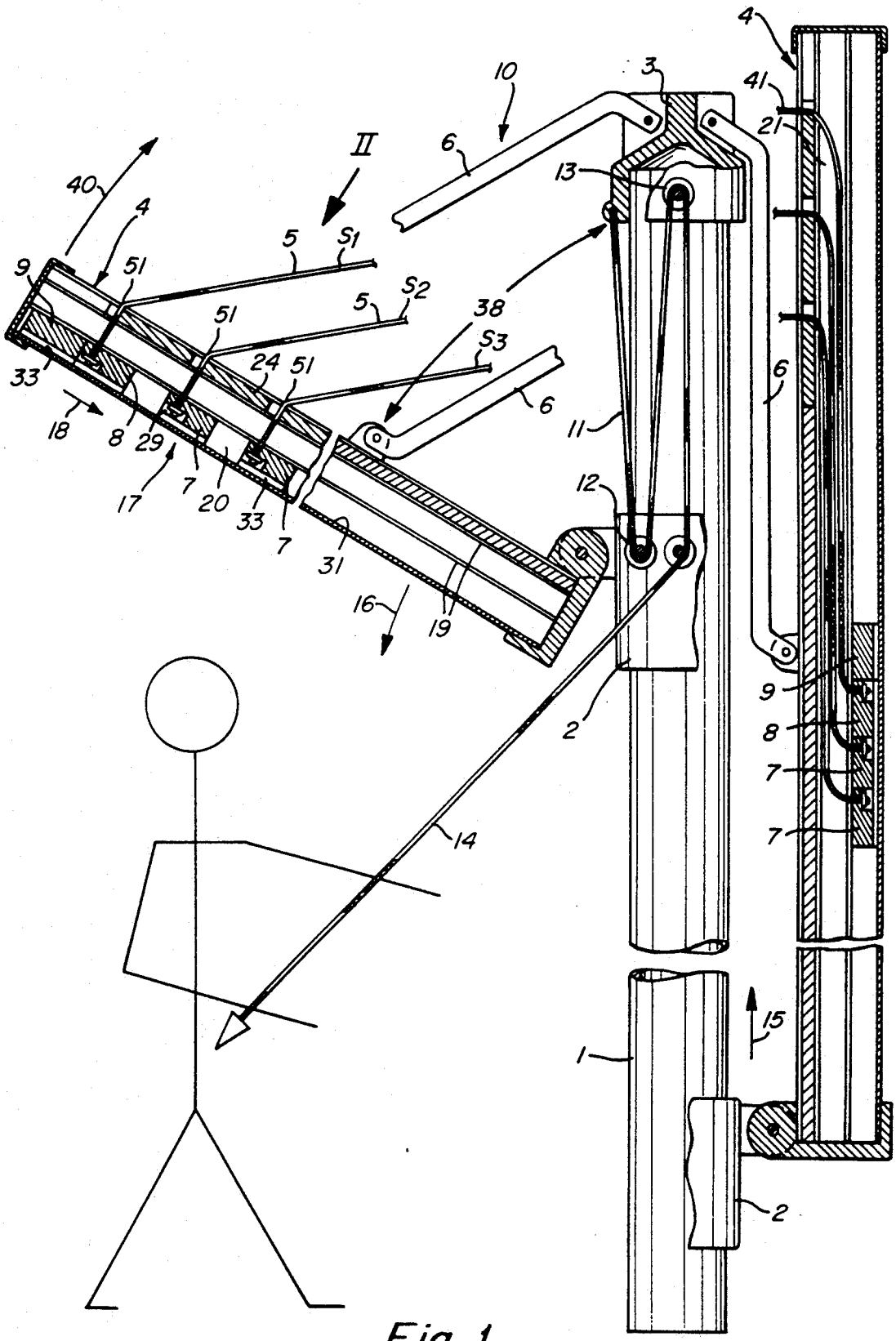
FIG. 1 shows a partly sectional view of an airing and drying frame according to the present invention, with the left half shown in an extended or unfolded position and the right half shown in a closed position, with the arms shown in cross section.

A mounting member (star) 2 is slideably mounted to a mast 1 in a manner as to be slidable along mast 1 in relation to a fixed member 3. The member 2 is lockable relative to the mast (locking means not shown) when in its upper position adjacent the fixed member 3. Swing-out arms 4 are pivotally mounted to the mounting member 2 with rope members (segments) 5 suspended between them. Swing-out arms 4 are supported relative to the fixed upper member 3 by means of pivotable expansion arms 6. The individual ends of the rope members 5, in the vicinity of the respective rope corners or bends 51, are each connected to a respective slider 7 which is mounted inside a sliding channel 20 of the arm 4. A weight 9 is situated in front of each outermost slider 8 in each arm 4, or the outermost slider 8 is designed as a weight. Preferably, the weight 9 or outermost slide 8 (weight) is made of lead and is slideably guided in the sliding channel 20 formed in each arm 4.

To open the expansion frame 10, which comprises the swing-out arms 4 and the expansion arms 6, a pull rope 11 is attached to the fixed member 3 near the top of the mast 1. As seen in FIG. 1, the pull rope 11 runs from the fixed member 3, is mounted around a pulley-type device 12 on the mounting member 2, is then run around another pulley-type member 13 on fixed member 3 and is again returned to another pulley-type device on the mounting member 2, and rope part 14 extends to the user for operating the device.

Figure 2:
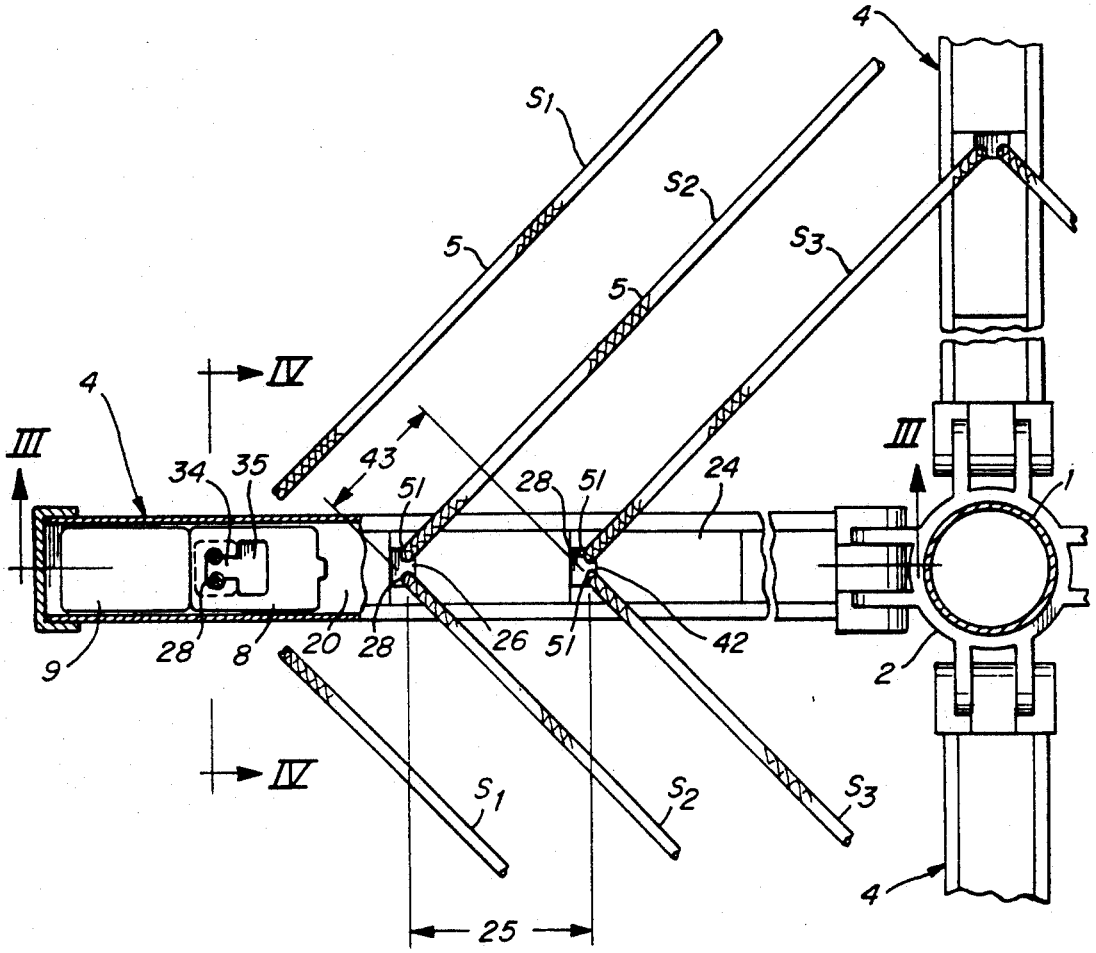
FIG. 2 is a partial view taken in direction II of FIG. 1.
Figure 4:
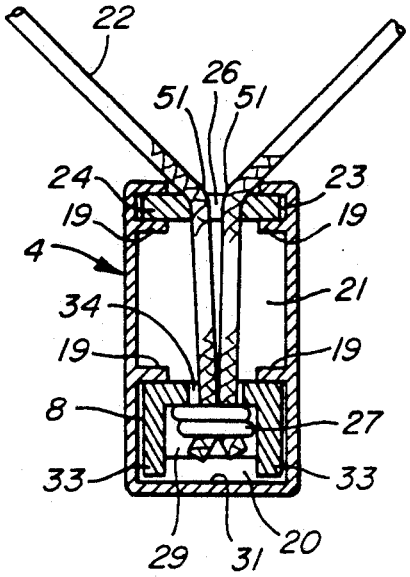
FIG. 4 is a cross sectional view taken along the line IV—IV in FIG. 2.

Each of the swing-out arms 4 comprises an elongated member having a generally box-type profile, open on one side, as seen in FIG. 4. Longitudinal fins or projections 19 (FIG. 4) extend from the inner side walls and divide the inner space of the arms 4 into a sliding channel 20, serving as guide for sliders 7 and 8 and slideable weight 9, a clothesline compartment 21 for receiving the clothesline 22, and a compartment 23 for the segment covers 24. The segment covers 24 are preferably of the same length as the rope corner distance 25 (see FIG. 2) between two neighboring rope corners 51 and are provided with respective openings 26 (FIG. 4) for the clothesline 22 to pass therethrough.

Figure 3:
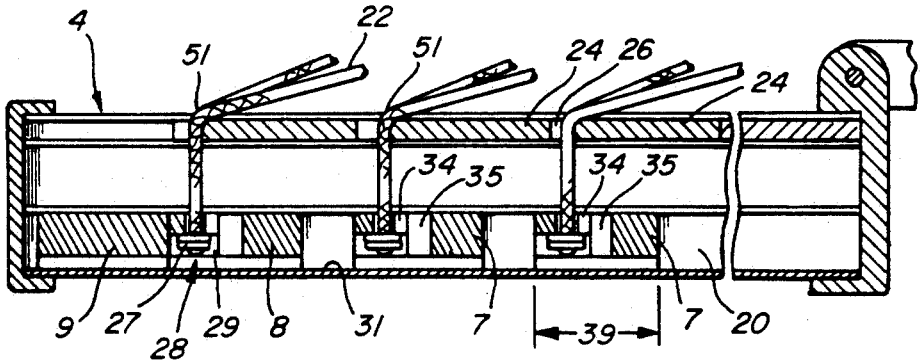
FIG. 3 is a cross sectional view taken along the line III—III in FIG. 2.

The clothesline 22 is designed in the shape of individual rope segments 5. The rope segments 5, when projected to the ground, form a substantially square shape and are provided with clips or clamps 27 (see FIGS. 3 and 4) at their end portions 28. With these clips 27, the end portions 28 of the individual rope segments 5 are clipped or fixed in the individual receiver areas 29 of the sliders 7 and 8. As seen clearly in FIG. 4, the clips or clamps 27 cannot pass through the openings 34 in the sliders 7 and 8, thereby fixing the end portions 28 of the rope segments 5 to the sliders 7, 8.

The sliders 7 and 8 are preferably provided with two glide risers 33, as can be seen clearly in FIG. 4 to enhance slideablility in sliding channel 20. An oblong hole 34 (see FIG. 2) with a broadened inlet opening 35 facilitates the mounting of the clips 27.

Referring to FIG. 1, the sequence of movements in operating the airing frame is explained. Beginning with the closed position, when pulling on the operating part 14 of the pull rope 11, the mounting member 2 will move upwardly in the direction of the arrow 15, and the swing-out arms 4 will undergo an expansion or swinging out movement as shown by the arrow 16 in FIG. 1. Sliders 7 and 8 are pulled into their respective final positions 17 (see FIG. 1 and FIGS. 2 and 3), and the rope segments 5 are pulled taut due to the rope 5 passing through the openings 26 of the segment covers 24.

When closing the airing frame, the mounting member or star 2, being secured or locked in the upper position to the mast 1 with a latch, not shown, is unlatched. The closing sequence is initiated by tilting the pivotable arms 4 upwardly in the direction of the arrow 40 (FIG. 1). In the initial phase of the closing process, the path of the mounting member or star 2 on the mast 1 is longer than the retraction of the clothesline. Beginning at a certain expansion angle 38 (FIG. 1), the inertia of the outermost slider 8, or the weight 9 respectively, is overcome. It begins sliding inwardly toward the mast 1 in the direction of arrow 18. Through the sliding action of the weight 9 (or 8), the retraction of the rope segments 5, beginning with the outermost rope segment $S_1$, starts. The outermost slider 8 begins to move toward the inside (i.e., toward the mast 1) and takes the next slider 7 along with it. Retraction of the next rope segment $S_2$ starts and cause retraction of the next rope segment $S_3$, after slider 7 strikes the next slider. Tilting of the arms 4 is aided by the pull of the weights 9 through the clothesline. In the closed position of the expansion frame 10, (as shown at the right side of FIG. 1), the sliders 7, 8 are close to each other; the clothesline 22 and the rope parts 41 of the rope segments 5 close to the mast 1, respectively, are taut.

To achieve substantially equal tension of the rope parts 41 close to the mast 1, the sliders 7 and 8 each must have a length 39 (see FIG. 3) equal to half the difference in length between two neighboring rope segment sections, for example $\frac{1}{2}(S_2-S_3)$.

The distance between the innermost connection point 42 (see FIG. 2) of the innermost rope segment $S_3$ from the mast 1 is equal to half the length of the rope segment $S_3$ plus the length 39 of slider 7. The sliders 7, 8 are all of the same length when the distances 25 (FIG. 2) between the end portions of the individual adjacent rope segments 5 are equal.

In order to improve sliding of the sliders 7, 8 within the sliding channel 20, the sliders 7, 8 can be coated with a friction reducing material such as polytetrafluoroethylene (Teflon) or other appropriate friction reducing coatings. Alternatively, or in addition to coating sliders 7, 8, the inner sliding surfaces 31 of the sliding channel 20, along which the sliders 7, 8 slide, may be coated with a friction reducing material such as polytetrafluoroethylene (Teflon) or other suitable material.

While two glide risers 33 are shown in FIG. 4, other surface configurations having reduced surface-to-surface contact areas, could be used to enhance slideability.

If desired, all or some of the sliders 7, 8 can be made of a heavy material, such as lead, to serve as weights. At least the outermost slider or sliders should preferably serve as weights.

While having described above the principles of the invention in connection with specific apparatus, it is to be clearly understood that this description is made only by way of example and not as a limitation to the scope of the invention as set forth in the accompanying claims.

What is claimed is:

1. A frame for airing and drying articles, comprising:

support means;

a plurality of arms extending from said support means and being pivotable relative to said support means between a folded position where said arms are adjacent said support means and an open position where said arms extend from said support means;

a clothesline extending between adjacent arms and on which articles are to be hung;

said arms each including retracting means for retracting the clothesline into the arms when the frame is folded to said folded position where said arms are adjacent said support means;

said retracting means comprising a plurality of slider members slidable on said arms and which are movable relative to each other, end portions of said clothesline being attached to respective slider members; and said retracting means further comprising an operating weight member at the outermost slider member on each of said arms, said operating weight member being slidable along the respective arm, solely by the force of gravity, responsive to a raising movement of said respective arm from said open position to said folded position, and said operating weight member acting on the outermost slider member to cause said outermost slider member to slide downwardly of said arm when said arm is raised toward said folded position, and to cause said outermost slider member to successively force downwardly the other slider members in said arm, to thereby draw the clothesline into the respective arms.

2. The frame of claim 1, wherein said arms each comprise a sliding channel (20) provided in said arms for slidably receiving said slider members and said operating weight member.

3. The frame of claim 2, wherein the outermost slider element comprise said operating weight member.

4. The frame of claim 1, wherein the outermost slider member comprises a weight member and comprises said operating weight member.

5. The frame of claim 1, wherein the outermost slider member and each of the other respective slider members comprise weight members.

6. The frame of claim 1, wherein said slider members are coated with a friction reducing material to improve sliding along said arm.

7. The frame of claim 2, wherein said sliding channel is coated with a friction reducing material.

8. The frame of claim 7, wherein said slider members are coated with a friction reducing material.

9. The frame of claim 2, wherein said slider members are coated with a friction reducing material.

10. The frame of claim 1, wherein at least one of said operating weight member and outermost slider member is provided with glide risers (33) to enhance slidability relative to said arm.

11. A frame for airing and drying articles, comprising:

an upright mast;

a plurality of arms extending from said mast and being pivotable relative to said mast between a folded position where said arms are adjacent said mast and an open position where said arms extend from said mast;

a clothesline extending between adjacent arms and on which articles are to be hung;

said arms each including retracting means for retracting the clothesline into the arms when the frame is folded to said folded position where said arms are adjacent said mast;

said retracting means comprising:

an elongated sliding channel formed in each of said arms;

a plurality of slider members slidable in said sliding channel and which are movable relative to each other in said sliding channel, end portions of said clothesline being attached to respective slider members; and an operating weight member at the outermost slider member in said sliding channel of each of said arms, said operating weight member being slidable along the respective sliding channel, solely by the force of gravity, responsive to a raising movement of said arm from said respective open position to said folded position, and said operating weight member acting on the outermost slider member to cause said outermost slider member to slide in said sliding channel downwardly of said arm and toward said mast when said arm is raised toward said folded position, and to cause said outermost slider member to successively force downwardly the other slider members in said arm, to thereby draw the clothesline into the respective arms.

12. The frame of claim 11, wherein said arms each further comprise an elongated clothesline storing compartment provided in said arms for receiving and storing said clothesline therein.

13. The frame of claim 12, wherein the outermost slider element comprises said operating weight member.

14. The frame of claim 11, wherein the outermost slider member comprises said operating weight member.

15. The frame of claim 11, wherein the outermost slider member and each of the other respective slider members comprise weight members.

16. The frame of claim 11, wherein said slider members are coated with a friction reducing material to improve sliding along said sliding channel.

17. The frame of claim 11, wherein said sliding channel is coated with a friction reducing material.

18. The frame of claim 17, wherein said slider members are coated with a friction reducing material.

19. The frame of claim 12, wherein said arms include segment covers covering said storing compartment and defining openings to receive said clothesline through said openings and into said storing compartment of said arms.

20. The frame of claim 11, wherein at least one of said operating element and outermost slider member is provided with glide risers (33) to enhance slideability relative to said arm.

* * * * *